United States Patent [19]

Nelson, Jr.

[11] Patent Number: 4,641,478

[45] Date of Patent: Feb. 10, 1987

[54] CONSTRUCTION BOLT HOLDER

[76] Inventor: E. Delbert Nelson, Jr., 10245 Parr Ave., Sunland, Calif. 91040

[21] Appl. No.: 830,321

[22] Filed: Jan. 27, 1986

[51] Int. Cl.[4] ..... E04C 5/12

[52] U.S. Cl. ..... 52/704; 52/700; 52/708

[58] Field of Search ..... 52/704, 700, 706, 707, 52/708

[56] References Cited

U.S. PATENT DOCUMENTS 1,212,843 1/1917 Struchen ..... 52/700
1,735,259 11/1929 Miller et al. ..... 52/707 X
2,165,882 7/1939 Birch ..... 52/707 X
2,517,979 8/1950 Collins ..... 52/708 X

*Primary Examiner*—J. Karl Bell
*Attorney, Agent, or Firm*—William W. Haefliger

[57] ABSTRACT

A mount for a construction bolt to be embedded in poured concrete includes:

(a) a standard having a supportable base, and defining a support for the lower end of a bolt, so that the bolt shank projects upwardly, (b) the standard having surfaces and openings whereby the poured concrete can flow onto and through the standard, and below the support and the bolt lower end, to anchor the standard with the bolt held in upright position.

11 Claims, 4 Drawing Figures

CONSTRUCTION BOLT HOLDER

BACKGROUND OF THE INVENTION

This invention relates generally to the mounting of construction bolts at construction sites, for reception of poured concrete; and more particularly concerns novel and highly useful mounts for such bolts to hold them in vertical position.

Construction anchor bolts are used in poured concrete footings to anchor wooden or steel framing to the footings. There is a long-standing need for simple, inexpensive means to securely hold the bolts in vertical position, at correct elevation, so that concrete can be poured onto them and around them, for retaining the bolts in position when the concrete cures.

SUMMARY OF THE INVENTION

It is a major object of the invention to provide an anchor bolt mount of improved construction, meeting the above need. Basically, the mount comprises:

(a) a standard having a supportable base, and defining a support for the lower end of a bolt, so that the bolt shank projects upwardly, (b) the standard having surfaces and openings whereby the poured concrete can flow onto and through the standard, and below the support and the bolt lower end, to anchor the standard with the bolt held in upright position.

As will appear, the standard typically includes first and second upright sections which are relatively angled, the base including first and second sections integral with the respective standard first and second sections; the standard may have V-shaped configuration in horizontal cross section; and the mount may consist of sheet metal, the base sections having fold connection to the bottoms of the standard sections, there being legs having fold connection to the base sections. Balance is thereby achieved.

Further, the legs may be spaced apart, and the standard and base may contain multiple openings to pass concrete so that concrete completely surrounds and penetrates base and legs, whereby the bolt is securely positioned. Fasteners will be employed to attach the base sections to the shoring platform on which the legs are seated.

The bolt may have a lateral lower leg (J-bolt configuration), and the leg is typically received through an opening in the standard, at a fold between the standard sections, to center the bolt, and its weight, relative to the base sections, for balanced support of the bolt.

These and other objects and advantages of the invention, as well as the details of an illustrative embodiment, will be more fully understood from the following specification and drawings, in which:

DRAWING DESCRIPTION

DETAILED DESCRIPTION

Figure 1:
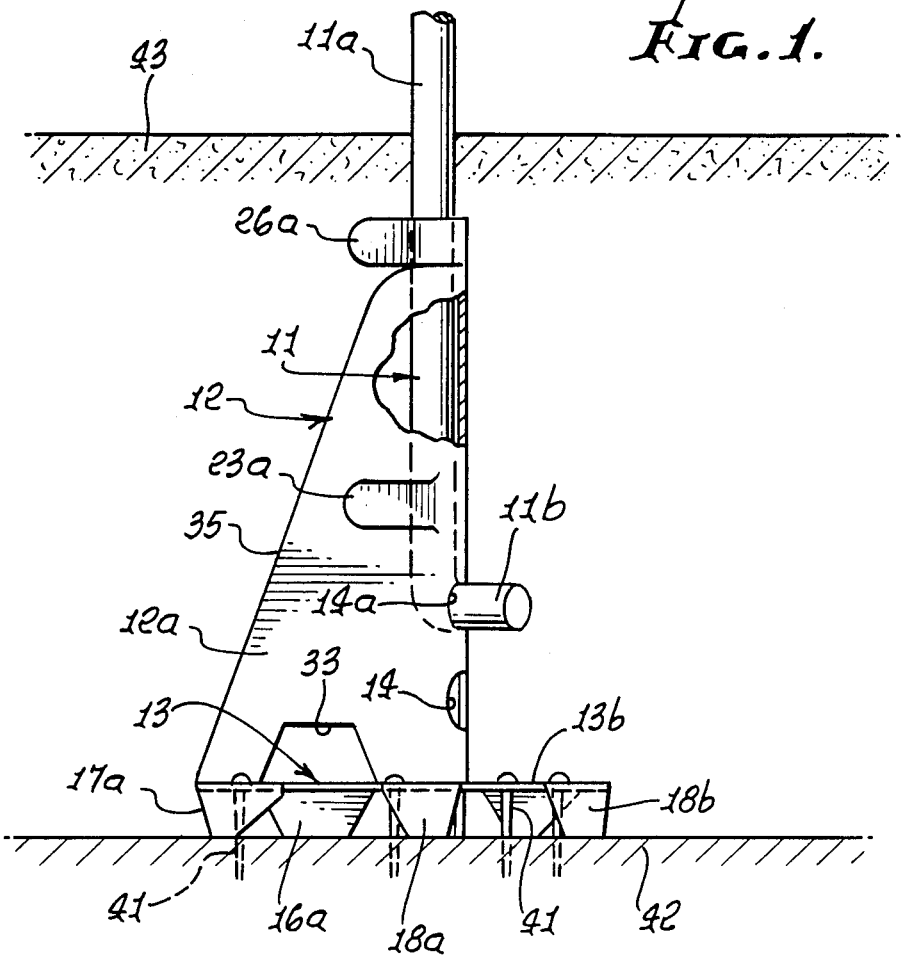
FIG. 1 is an elevation showing one form of the invention.
Figure 2:
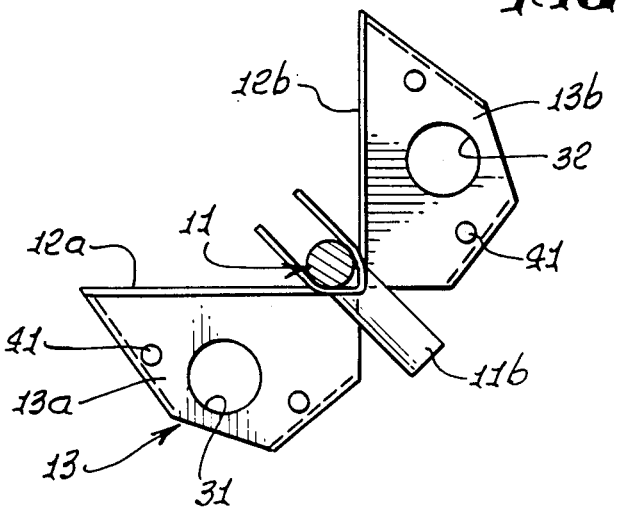
FIG. 2 is a top plan view of the mount seen in FIG. 1.
Figure 3:
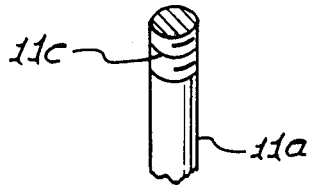
FIG. 3 is a perspective view of the mount.

In FIGS. 1–3, a mount 10 for a steel bolt 11 is adapted to retain the bolt shank 11*a* vertically, while supporting the bolt short lateral leg 11*b*. The mount includes a standard 12 having a supportable base 13, and defining a support for the bolt lower end, i.e. leg 11*b*, so that the shank 11*a* extends vertically. That support may take the form of a hole 14 through the standard. A second such hole 14*a* may be provided at a different elevation, to support the bolt at a higher elevation, for example.

Figure 4:
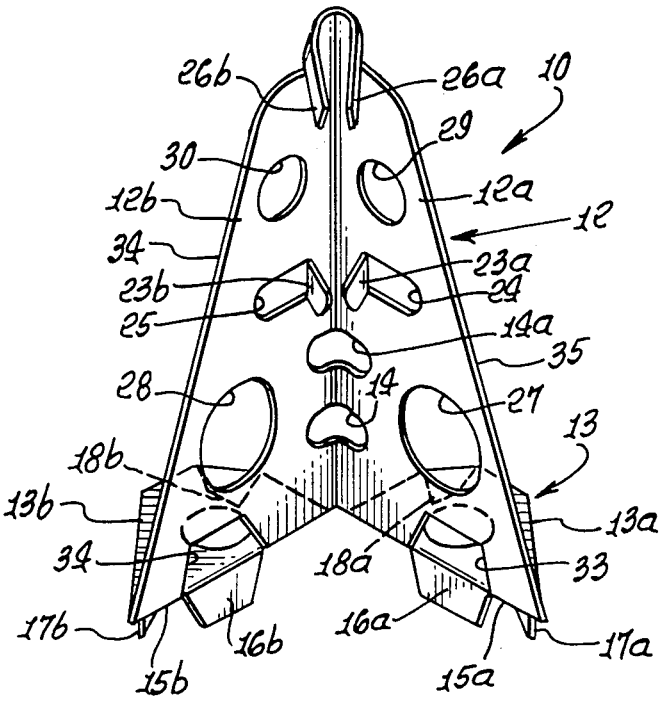
FIG. 4 is a developed sheet of a blank form which the mount may be formed.
Figure 4:
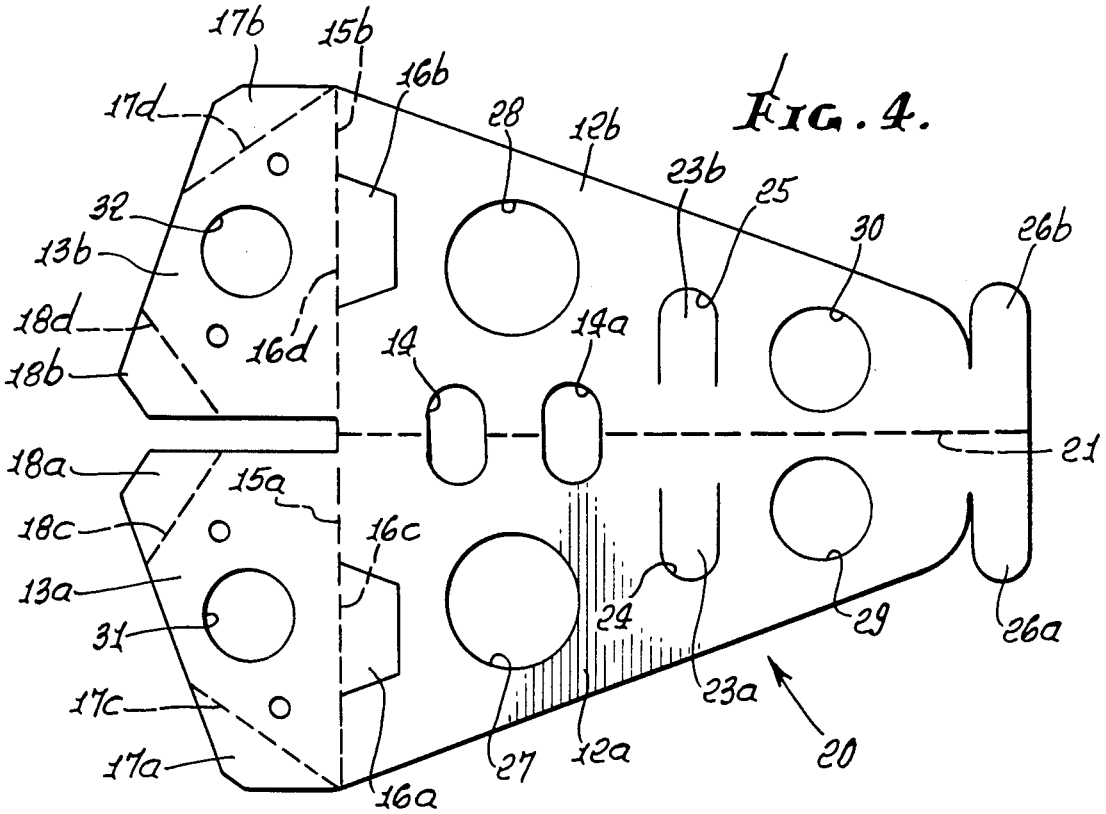

The standard and base may with unusual advantage consist of thin sheet material, such as sheet metal, which is foldable to form the standard to shape (generally V-shaped in horizontal cross sections) and to fold the base sections 13*a* and 13*b* from the lower ends of the thus formed standard sections 12*a* and 12*b* and along fold lines 15*a* and 15*b*. Also, tab legs 16*a*, 17*a* and 18*a* on base section 13*a*, and 16*b*, 17*b* and 18*b* on base section 13*b*, may be formed by folding on lines 16*c*, 17*c* and 18*c*, and on lines 16*d*, 17*d* and 18*d*. FIG. 4 shows a blank 20 from which the standard, base and legs may be formed, by folding. Note that a fold line 21 exists between standard sections 12*a* and 12*b*.

Pairs of bolt shank retention tabs are formed on the standard sections. See for example the lower pair of tabs 23*a* and 23*b* punched out to form concrete penetration openings 24 and 25; and the upper pair of tabs 26*a* and 26*b*. Auxiliary holes 27, 28, 29 and 30 are formed in the standard sections and holes 31 and 32 in base sections to pass concrete. See also holes 33 and 34 formed by punched out leg tabs 16*a* and 16*b*. Thus, fluid concrete can flow onto and through the standard and below the support or base, to surround the legs, all with the bolt held in upright position and surrounded by concrete. Note in this regard that the standard has edges 34 and 35 that flare downwardly toward the base.

FIG. 1 also shows nail 41 passing downwardly from the base sections to penetrate the platform 42, to hold the base sections to the platform. Concrete 43 is filled onto the platform to pass around and through the standard and the base sections, and surround the legs and bolt. The bolt has an upper threaded end portion 11*c* to pass through a wooden or steel member, so that a nut may be threaded on end 11*c* and hold the member to the concrete footing.

The developed sheet 20 makes formation of the mount, by stamping and folding, very simple.

I claim:

1. A mount for a construction bolt to be embedded in poured concrete and including said bolt in combination with the mount comprising (a) a standard having a supportable base, and defining a support for the lower end of the bolt, so that the bolt shank projects upwardly, the standard including first and second upright sections which are relatively angled to defined a vertical fold, the bolt having a shank proximate the fold, the base including first and second sections integral with the respective standard first and second sections, (b) the standard having surfaces and openings whereby the poured concrete can flow onto and through the standard, and below the support and the bolt lower end, to anchor the standard with the bolt held in upright position, one of said openings located at the fold and passing a turned end defined by the bolt to locate the bolt relative to the standard, (c) there being at least one retainer on the standard proximate the fold and above said one opening, for retaining the bolt shank to the standard, proximate the vertical fold.

2. The mount of claim 1 wherein the standard flares downwardly relative to the base and forms at least one of said openings to pass concrete therethrough.

3. The mount of claim 2 wherein the base includes multiple legs, and spaces between the legs to pass concrete flowing past said standard.

4. The mount of claim 1 wherein the mount consists of sheet metal and each base section has multiple legs integral therewith, the entire mount formed from only one sheet metal blank.

5. The mount of claim 1 wherein the retainer is in the form of tabs integral with the standard, and foldable relative to said fold to accommodate to the bolt shank.

6. The mount of claim 1 wherein the standard is generally V-shaped in horizontal cross sections.

7. The mount of claim 6 which consists of sheet metal, the base sections having fold connection to the bottom of the standard sections, there being legs having fold connection to the base sections, the base sections located at opposite sides of an axis defined by the bolt shank.

8. The mount of claim 7 wherein said standard sections and base sections define through openings to pass concrete.

9. The mount of claim 7 including a platform supporting said legs which project downwardly, fasteners retaining the base sections to the platform, and concrete surrounding the standard and a bolt supported thereby.

10. The mount of claim 4 including bolt retention tabs on the standard sections, and punched therefrom to form concrete passing openings therein, the tabs located proximate said vertical fold and at different elevations relative to said one opening that passes the bolt turned end.

11. The mount of claim 1 wherein said standard consists of sheet metal, and another of said openings is located at the fold and vertically spaced from said one opening, said other opening sized to alternatively receive the bolt turned end, for adjusting the bolt height relative to the standard.

* * * * *